US012759675B2

(12) United States Patent
Lang et al.

(10) Patent No.: US 12,759,675 B2
(45) Date of Patent: Oct. 13, 2026

(54) FURNITURE ASSEMBLY FOR A WATERCRAFT AND WATERCRAFT HAVING THE SAME

(71) Applicant: BRP MARINE US INC., Clinton, MI (US)

(72) Inventors: Serge Lang, Valcourt (CA); Ryan Jones, Wauwatosa, WI (US)

(73) Assignee: BRP MARINE US INC., Clinton, MI (US)

( * ) Notice: Subject to any disclaimer, the term of this patent is extended or adjusted under 35 U.S.C. 154(b) by 462 days.

(21) Appl. No.: 18/365,301

(22) Filed: Aug. 4, 2023

(65) Prior Publication Data

US 2025/0019048 A1 Jan. 16, 2025

Related U.S. Application Data

(60) Provisional application No. 63/513,692, filed on Jul. 14, 2023.

(51) Int. Cl.

| | |
|---|---|
| ***B63B 29/04*** | (2006.01) |
| ***A47B 83/02*** | (2006.01) |
| ***A47C 7/62*** | (2006.01) |

(52) U.S. Cl.

CPC ..... *B63B 29/04* (2013.01); *A47B 83/02* (2013.01); *A47C 7/62* (2013.01); *B63B 2029/043* (2013.01); *B63B 2029/046* (2013.01)

(58) Field of Classification Search

CPC ..... B63B 29/04; B63B 2029/043; B63B 2029/046; A47B 3/14; A47B 83/02; B64D 11/0605

See application file for complete search history.

(56) References Cited

U.S. PATENT DOCUMENTS 640,322 A * 1/1900 Rogers ..... A47C 13/00 297/126
1,903,954 A * 4/1933 Blumenthal ..... A47B 83/02 108/134

(Continued)

FOREIGN PATENT DOCUMENTS

CN 108618447 A * 10/2018 ..... A47C 7/70
JP 5622464 B2 * 11/2014 ..... B60N 3/00

(Continued)

*Primary Examiner* — Magdalena Topolski

(74) *Attorney, Agent, or Firm* — BCF LLP

(57) ABSTRACT

A furniture assembly for a watercraft includes a base member configured to connect to a surface of the watercraft, a seat member moveably connected to the base member, and a table member moveably connected to the seat member. The seat member is moveable relative to the base member between a seating position and a seat stowed position. The table member is moveable relative to the seat member between an extended position and a table stowed position. The furniture assembly is selectively configured between a storage configuration, a seat configuration, and a table configuration. In the storage configuration, the seat member is in the seat stowed position and the table member is in the table stowed position. In the seat configuration, the seat member is in the seating position. In the table configuration, the seat member is in the seat stowed position and the table member is in the extended position.

20 Claims, 13 Drawing Sheets

(56) References Cited

U.S. PATENT DOCUMENTS

| | | | | |
|---|---|---|---|---|
| 2,820,507 | A * | 1/1958 | Provencher | A47C 13/00 297/230.12 |
| 8,840,175 | B2 * | 9/2014 | Short | A47C 13/00 297/122 |
| 9,446,849 | B1 * | 9/2016 | Pinkal | B60N 2/3015 |
| 9,688,168 | B2 * | 6/2017 | Gratz | B60N 2/309 |
| 9,783,271 | B2 * | 10/2017 | Foss | B63B 29/04 |
| 9,821,887 | B1 * | 11/2017 | Wilson | B63B 29/04 |
| 12,357,097 | B1 * | 7/2025 | Esham | A47C 7/70 |
| 2008/0000400 | A1 * | 1/2008 | Curry | A47C 7/70 108/162 |
| 2025/0121749 | A1 * | 4/2025 | Perry | B60N 3/102 |

FOREIGN PATENT DOCUMENTS

| | | | | |
|---|---|---|---|---|
| KR | 200331487 | Y1 * | 10/2003 | A47B 83/02 |
| KR | 101643499 | B1 * | 7/2016 | A47B 85/00 |

* cited by examiner

FURNITURE ASSEMBLY FOR A WATERCRAFT AND WATERCRAFT HAVING THE SAME

CROSS-REFERENCE

The present application claims priority to U.S. Patent Application No. 63/513,692, filed Jul. 14, 2023, which is incorporated by reference herein in its entirety.

TECHNOLOGICAL FIELD

The present technology relates to furniture assemblies for watercraft, and watercraft having furniture assemblies.

BACKGROUND

Watercraft often have decks upon which accessories and accommodations of the watercraft are disposed. Such accessories and accommodations can include furniture like tables and seats.

In some watercraft, the amounted of available space on the deck can be limited, and some of the accommodations on the watercraft may not be useful in certain conditions, thereby needlessly occupying the limited available space.

Thus, there is a desire for a furniture assembly for a watercraft that can efficiently use the available space.

SUMMARY

It is an object of the present technology to ameliorate at least some of the inconveniences present in the prior art.

According to one aspect of the present technology, there is provided a furniture assembly for a watercraft. The furniture assembly includes a base member, a seat member and a table member. The base member is configured to connect to a surface of the watercraft. The seat member is moveably connected to the base member, and is moveable relative to the base member between a seating position and a seat stowed position. The table member is moveably connected to the seat member, and is moveable relative to the seat member between an extended position and a table stowed position. The furniture assembly is selectively configured between a storage configuration, a seat configuration, and a table configuration. In the storage configuration the seat member is in the seat stowed position and the table member is in the table stowed position. In the seat configuration, the seat member is in the seating position. In the table configuration, the seat member is in the seat stowed position and the table member is in the extended position.

In some embodiments, in the seat configuration, the table member is in the table stowed position.

In some embodiments, the furniture assembly further includes a first seat connecting linkage, and a second seat connecting linkage. The first seat connecting linkage has a first end pivotally connected to the base member and a second end pivotally connected to the seat member. The second seat connecting linkage has a third end pivotally connected to the base member and a fourth end pivotally connected to the seat member. The first and second seat connecting linkages moveably connect the seat member to the base member.

In some embodiments, the first seat connecting linkage, the second seat connecting linkage, the seat member and the base member define a four-bar linkage assembly.

In some embodiments, in the seat stowed position, the third end is configured to be closer to the surface of the watercraft than the first, second and fourth ends, and in the seating position, the fourth end is disposed vertically above the second and third ends.

In some embodiments, the table member is pivotally connected to the seat member.

In some embodiments, the furniture assembly further includes first and second table connecting linkages. The first table connecting linkage is connected to one of the table member and the seat member. The first table connecting linkage defines a slot extending generally parallel to the one of the table member and the seat member. The second table connecting linkage is pivotally connected to an other one of the table member and the seat member. Part of the second table connecting linkage is received in the slot. The part of the second table connecting linkage being slidable along the slot between a first slot position, in which the table member is in the table stowed position, and a second slot position, in which the table member is in the extended position. The first and second table connecting linkages moveably connect the table member to the seat member.

In some embodiments, the furniture assembly further includes a table lock pivotally connected to the first table connecting linkage. The table lock is moveable between locked and unlocked positions. In the locked position, the table lock prevents the part of the second table connecting linkage to move from the second slot position toward the first slot position. In the unlocked position, the table lock permits movement of the second table connecting linkage to move from the second slot position toward the first slot position.

In some embodiments, in response to the part of the second table connecting linkage moving toward the second slot position, the part of the second table connecting linkage causes the table lock to move to the unlocked position.

In some embodiments, the table lock is biased towards the locked position.

In some embodiments, the furniture assembly further includes first and second seat locking members. The first seat locking member is connected to one of the seat member and the base member. The second seat locking member is connected to an other one of the seat member and the base member. The first seat locking member is moveable between a first position and a second position. With the seat member in the seat stowed position and the first seat locking member in the first position, the first and second locking members are engaged with one another, and prevent the seat member from moving from the seat stowed position. With the seat member in the seat stowed position and the first seat locking member in the second position, the first and second locking members are disengaged from one another, and the seat member is moveable toward the seating position.

In some embodiments, the first seat locking member is biased towards the first position.

In some embodiments, the furniture assembly further includes a first retainer connected to the seat member, a second retainer connected to the table member, the first and second retainers being selectively connected to one another for retaining the table member in the table stowed position.

In some embodiments, the base member defines a recess, and with the seat member being in the seat stowed position, the recess at least partially receives the seat member.

In some embodiments, with the furniture assembly being in the storage configuration, the recess at least partially receives the table member.

In some embodiments, the base member has a backrest.

In some embodiments, in the table stowed position, the table member rests against a bottom of the seat member.

In some embodiments, in the table extended position, a top of the table is configured to be generally parallel to an upper surface of the watercraft.

A furniture unit includes the furniture assembly according to the above aspect or according to the above aspect and one or more of the above embodiments. The furniture assembly is configured to connect to the surface of the watercraft, and the seat member is a first seat member. The furniture unit also includes a second seat member configured to connect to the surface of the watercraft, the second seat member being disposed adjacent to the furniture assembly. With the furniture assembly being in the seat configuration, the second seat member is generally vertically aligned with the first seat member. With the furniture assembly being in the table configuration, the table member is disposed vertically higher than the second seat member.

According to another aspect of the present technology, there is provided a watercraft. The watercraft includes a deck, a hull supporting the deck, a motor connected to the hull, a furniture assembly and a second seat member connected to the surface of the deck, the second seat member being disposed adjacent to the furniture assembly. The furniture assembly includes a base member, a first seat member and a table member. The base member is connected to a surface of the deck. The first seat member is moveably connected to the base member, and is moveable relative to the base member between a seating position and a seat stowed position. The table member is moveably connected to the first seat member, and is moveable relative to the first seat member between an extended position and a table stowed position. The furniture assembly is selectively configured between a storage configuration, in which the first seat member is in the seat stowed position and the table member is in the table stowed position, a seat configuration, in which the first seat member is in the seating position, and a table configuration, in which the first seat member is in the seat stowed position and the table member is in the extended position. With the furniture assembly being in the seat configuration, the second seat member is generally vertically aligned with the first seat member. With the furniture assembly being in the table configuration, the table member is disposed vertically higher than the second seat member.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
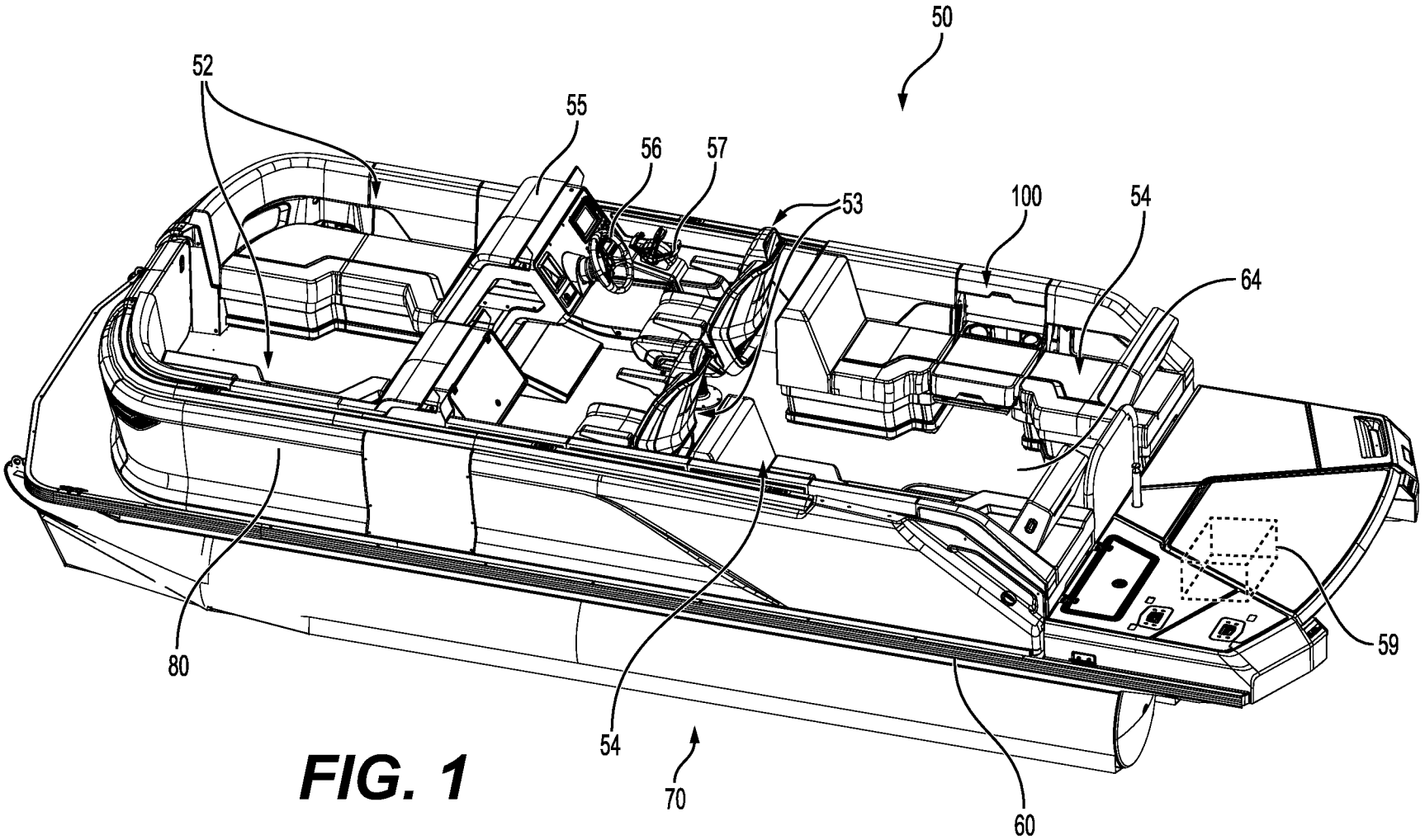
FIG. 1 is a perspective view taken from a top, left and rear side of a watercraft.

A watercraft 50 in accordance with one embodiment of the present technology is shown in FIG. 1. The following description relates to one example of a watercraft 50, notably a pontoon boat 50. Those of ordinary skill in the art will recognize that there are other known types of watercraft incorporating different designs and that the present technology would encompass these other watercraft.

For purposes of the description of the boat 50, terms related to spatial orientation when referring thereto and components in relation to the watercraft, such as "vertical", "horizontal", "forwardly", "rearwardly", "left", "right", "above" and "below", are as they would be understood by a driver of the watercraft sitting thereon in an upright driving position, with the watercraft being at rest and level.

The boat 50 has a deck 60 and a hull 70. The deck 60 is disposed on the hull 70, and is supported thereby. The deck 60 has an upper surface 64 for supporting occupants, as well as accessories and accommodations of the boat 50.

Notably, the boat 50 includes left and right front furniture units 52, left and right intermediate seats 53, and left and right rear furniture units 54, all of which are connected to the deck 60. The left and right front furniture units 52 each include two seats. The left and right intermediate seats 53 are swivel seats. It is contemplated that the left and right intermediate seats 53 could be other types of seats. The left and right rear furniture units 54, each of which includes a furniture assembly 100, will be described in greater detail below.

The boat 50 also includes a command console 55 that is disposed between the front right furniture unit 52 and the right intermediate seat 53. It is contemplated that the deck 60 could include multiple levels and/or other seating or other accessories integrated therein.

A powerpack 59 (schematically illustrated in FIG. 1) of the boat 50, including an outboard motor, is connected to the hull 70. The boat 50 is propelled by the jet propulsion system which is powered by the motor. The jet propulsion system has a steering nozzle (not shown) used for steering the boat 50. A steering wheel 56, which is disposed on the command console 55, is operatively connected to the steering nozzle. A throttle lever 57, which is also disposed on the command console 55, is operatively connected to the motor for controlling operation thereof. It is contemplated that other propulsion systems, such as a stern drive, a jet propulsion system or a marine inboard engine may be used to propel the boat 50.

The boat 50 further includes a side structure 80 surrounding at least part of the deck 60 and extending upwardly therefrom. In the present embodiment, the side structure 80 is a barrier structure 80. It is contemplated that that in some embodiments, the side structure 80 could be gunnels of the boat 50 or another type of structure. The barrier structure 80 is located along a periphery of the boat 50 (as defined by the deck 60). As best seen in FIG. 1, the barrier structure 80 generally covers the front, left and right sides of the deck 60. It is contemplated that, in other embodiments, the barrier structure 80 could surround the deck 60 completely.

Figure 2:
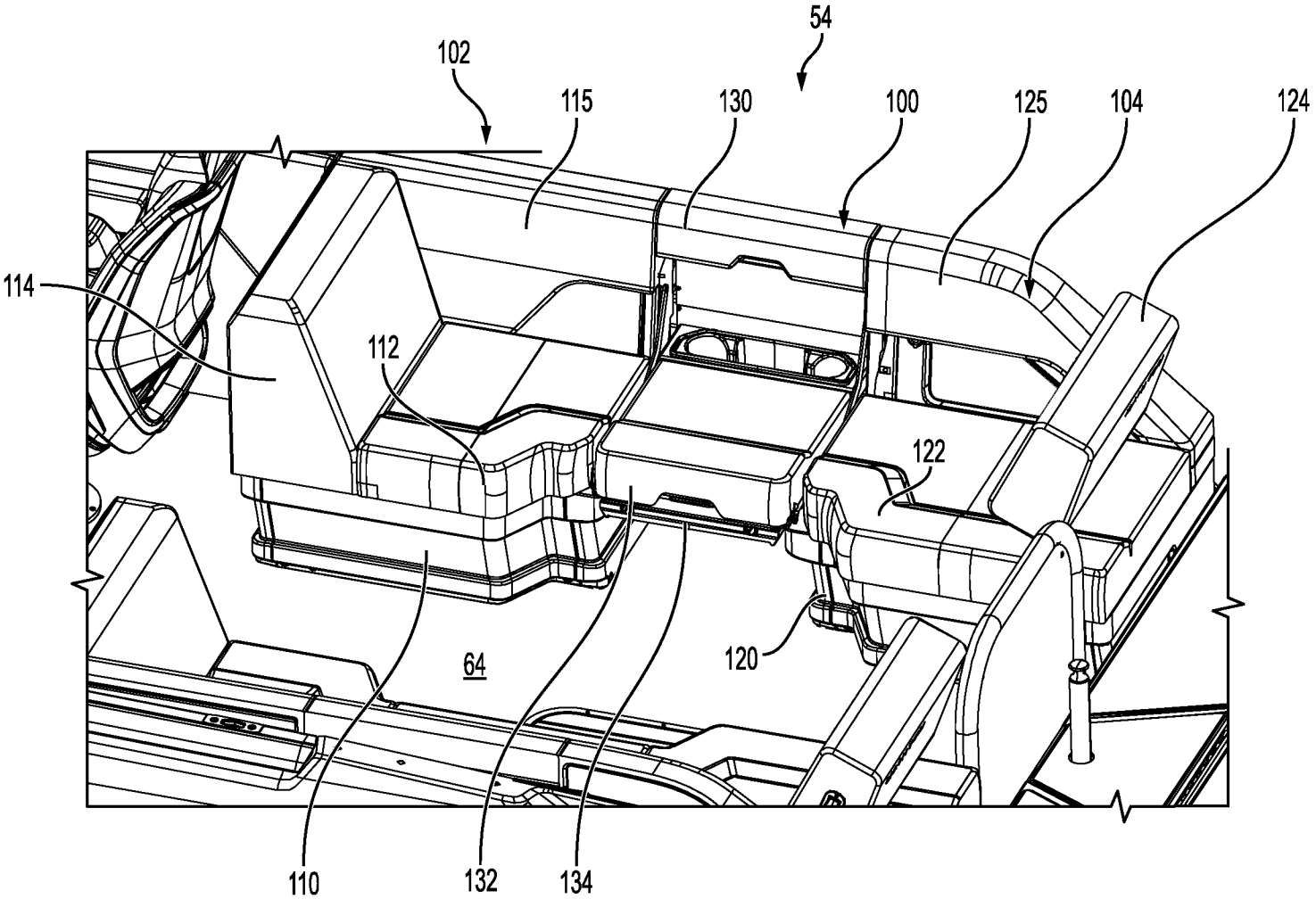
FIG. 2 is a perspective view taken from a top, left and rear side of a rear right portion of the watercraft of FIG. 1 showing a rear right furniture unit of the watercraft.
Figure 3:
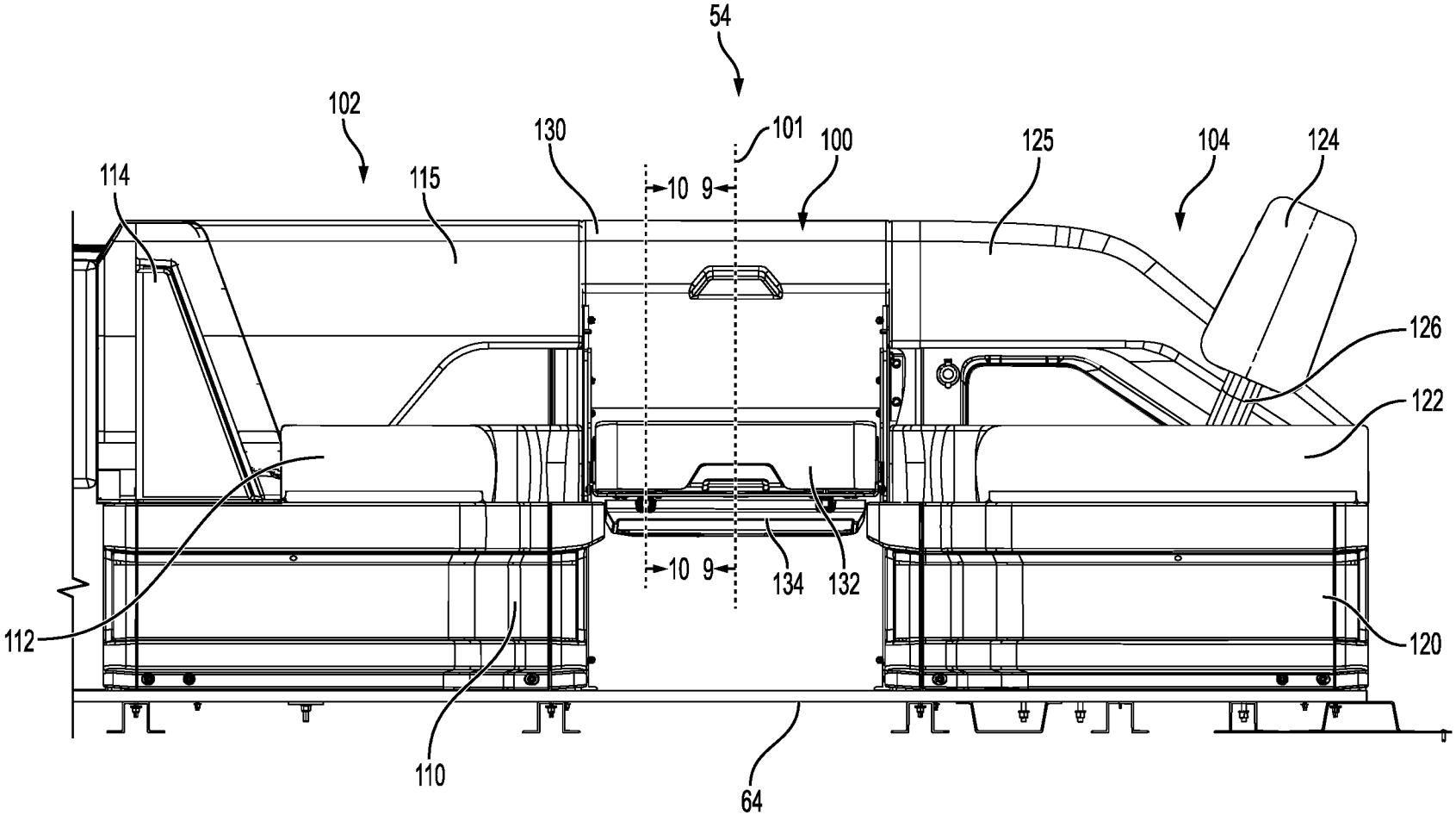
FIG. 3 is a left side elevation view of the right rear furniture unit of FIG. 2.
Figure 4:
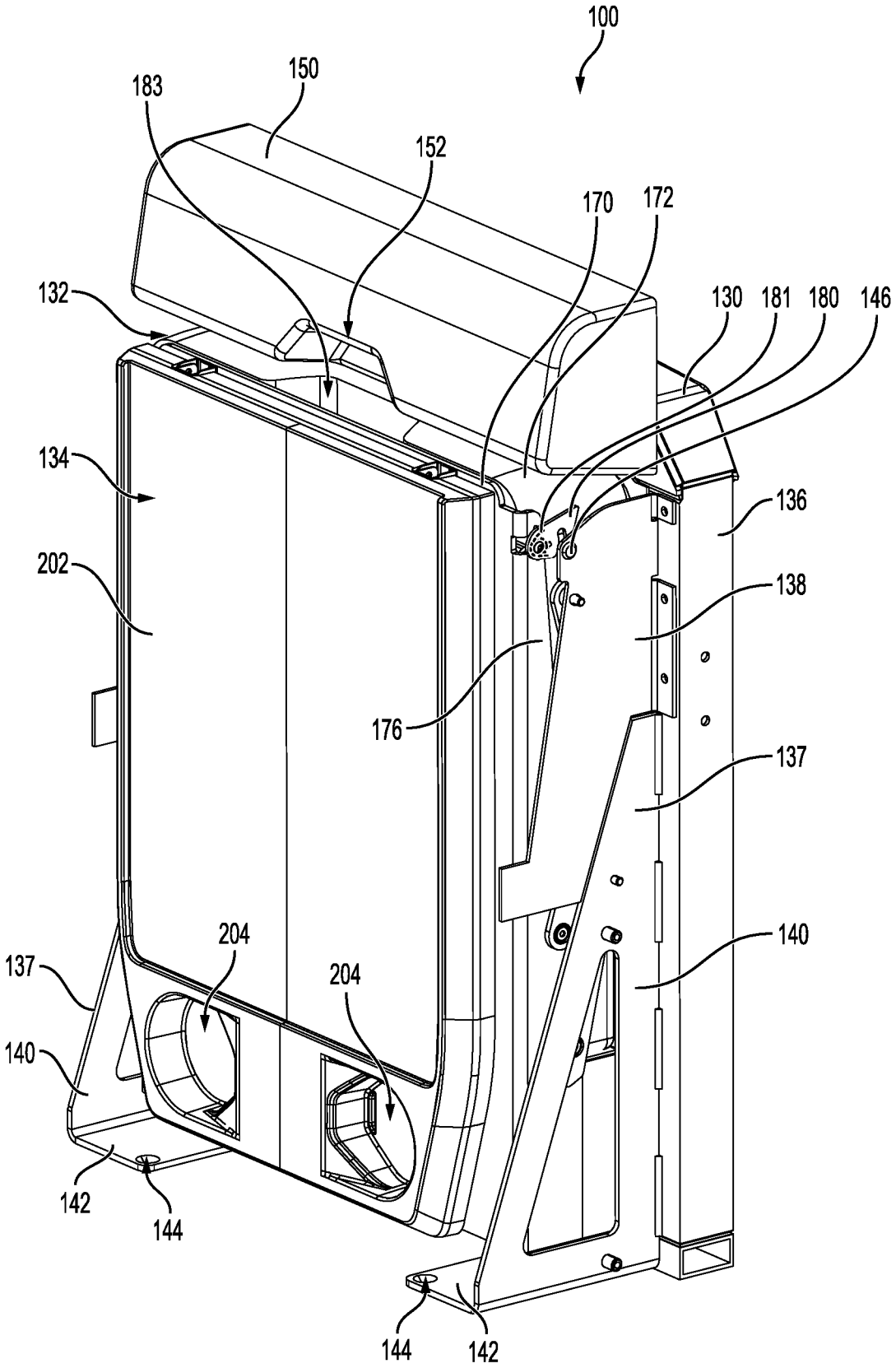
FIG. 4 is a perspective view taken from a top, rear and left side of a furniture assembly of the rear right furniture unit of FIG. 2, the furniture assembly being in a storage configuration.
Figure 5:
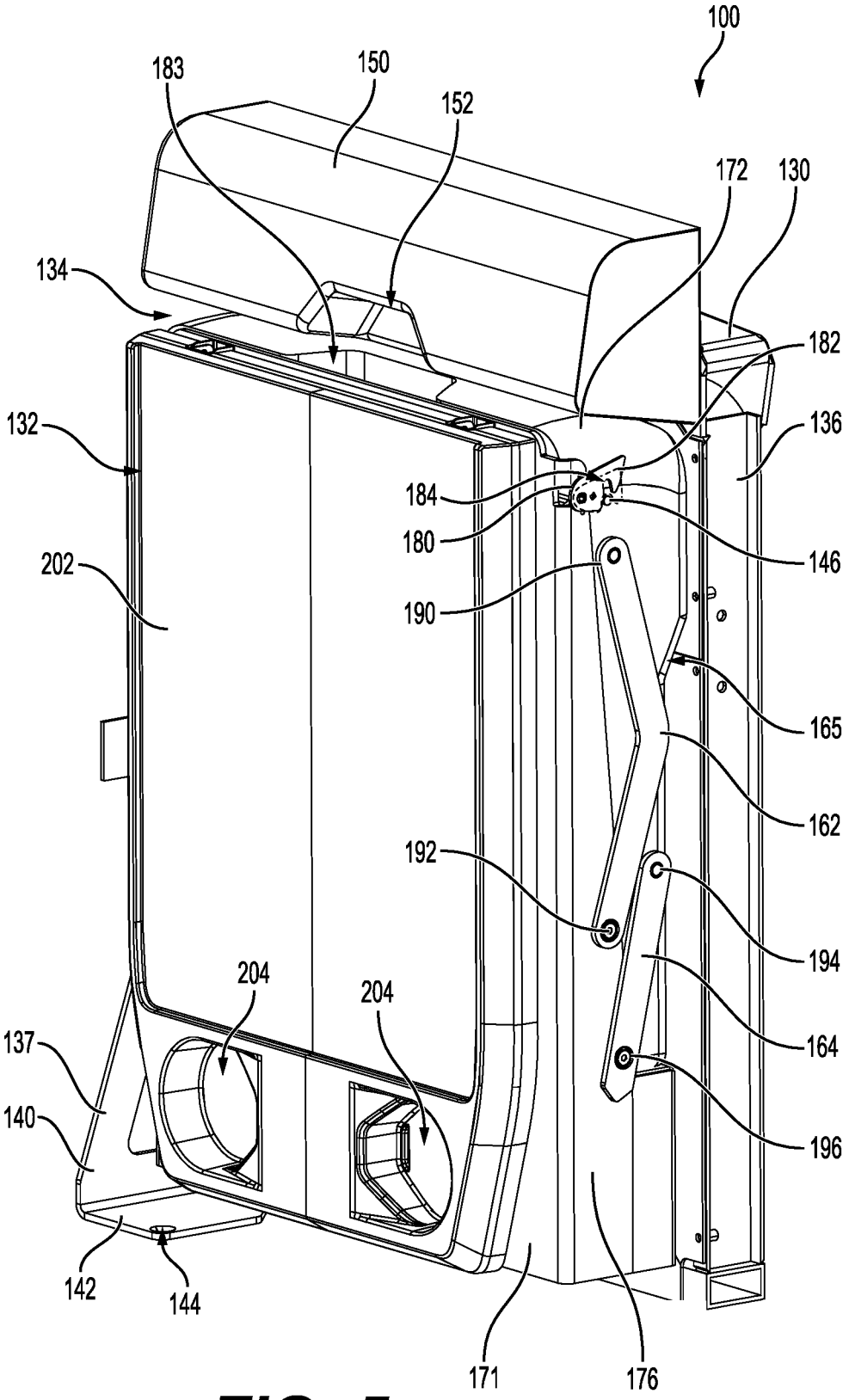
FIG. 5 is a cross-section view of the furniture assembly of FIG. 4.
Figure 6:
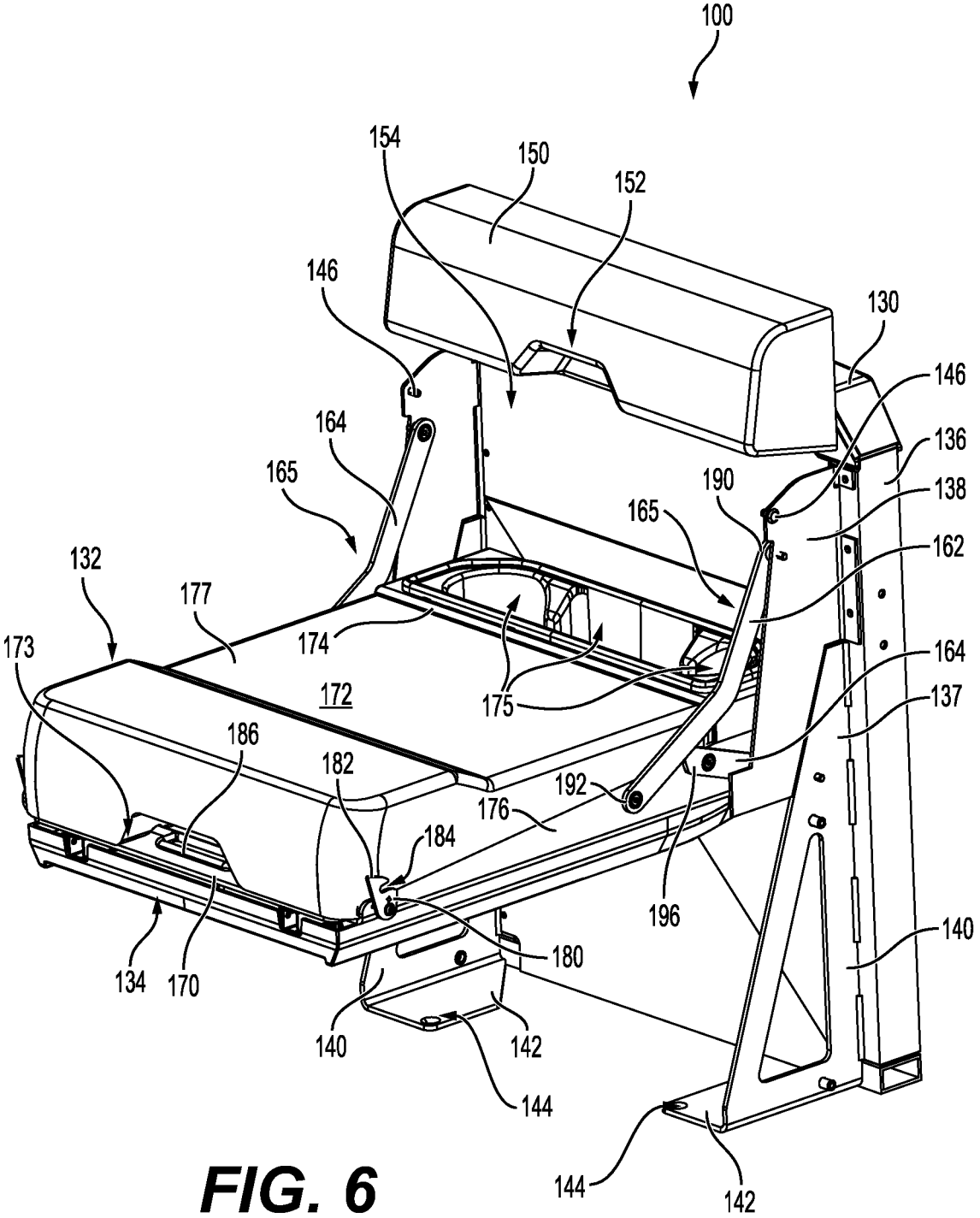
FIG. 6 is a perspective view taken from a top, rear and left side of the furniture assembly of FIG. 4, the furniture assembly being in a seat configuration.

With reference to FIGS. 1 to 3, the left and right rear furniture units 54 will now be described in greater detail. Since the left and right rear furniture units 54 are mirror images of one another, only the right rear furniture unit 54, henceforth simply referred to as furniture unit 54, will be described in detail herewith.

The furniture unit 54 includes the furniture assembly 100, a seat 102 disposed longitudinally forward from the furniture assembly 100, and a seat 104 disposed longitudinally rearward from the furniture assembly 100, such that the furniture assembly 100 is disposed longitudinally between the seats 102, 104. It is contemplated that in other embodiments of the boat 50, the furniture unit 54 could be configured such that the furniture assembly 100 would be disposed laterally between the seats 102, 104. It is also contemplated that the furniture unit 54 could include a different number of seats (e.g., a single seat or three or more seats), be positioned elsewhere on the boat 50 and/or two or more furniture assemblies 100.

The seat 102 has a base member 110, a seat member 112, a backrest 114 and a backrest 115. The base member 110 is connected to the deck 60. The seat member 112 is disposed on the base member 110. The seat member 112 is a cushioned seat member 112. The backrest 114 is also disposed on the base member 110 at a longitudinally forward end thereof, such that the backrest 114 abuts a front end of the seat member 112. The backrest 114 is a cushioned backrest 114. The backrest 115 is also disposed on the base member 110 at a lateral end thereof, such that part of the backrest 115 abuts the barrier structure 80 and another part abuts a lateral end of the seat member 112. The backrest 115 is a cushioned backrest 115.

The seat 104 has a base member 120, a seat member 122, a backrest 124 and a backrest 125. The base member 120 is connected to the deck 60. The seat member 122 is disposed on the base member 120. The seat member 122 is a cushioned seat member 122. The backrest 124 is connected to a connecting member 126, which is hingedly connected to the base member 120. The backrest 124 is disposed at a longitudinal rear end of the base member 120 such that the seat 104 is forward facing. But the backrest 124 and the connecting member 126 can be pivoted forward about a lateral axis such that the backrest 124 is disposed at a longitudinal front of the base member 120, thereby rendering the seat 104 rearward facing. The backrest 124 is a cushioned backrest 124. The backrest 125 is also disposed on the base member 120 at a lateral end thereof, such that part of the backrest 125 abuts the barrier structure 80 and another part abuts a lateral end of the seat member 122. The backrest 125 is a cushioned backrest 125.

Figure 11:
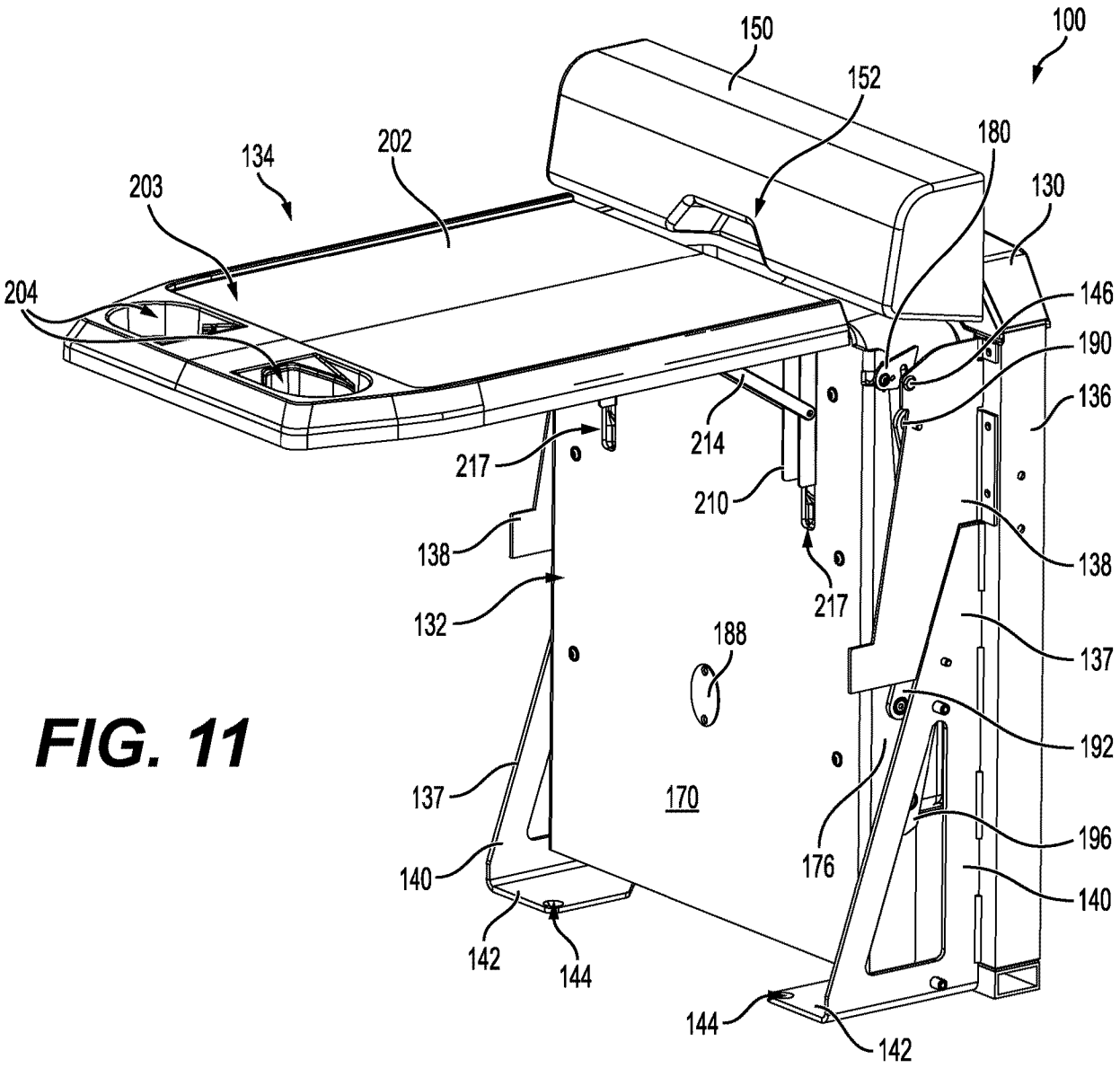
FIG. 11 is a perspective view taken from a top, rear and left side of the furniture assembly of FIG. 4, the furniture assembly being in a table configuration.
Figure 12:
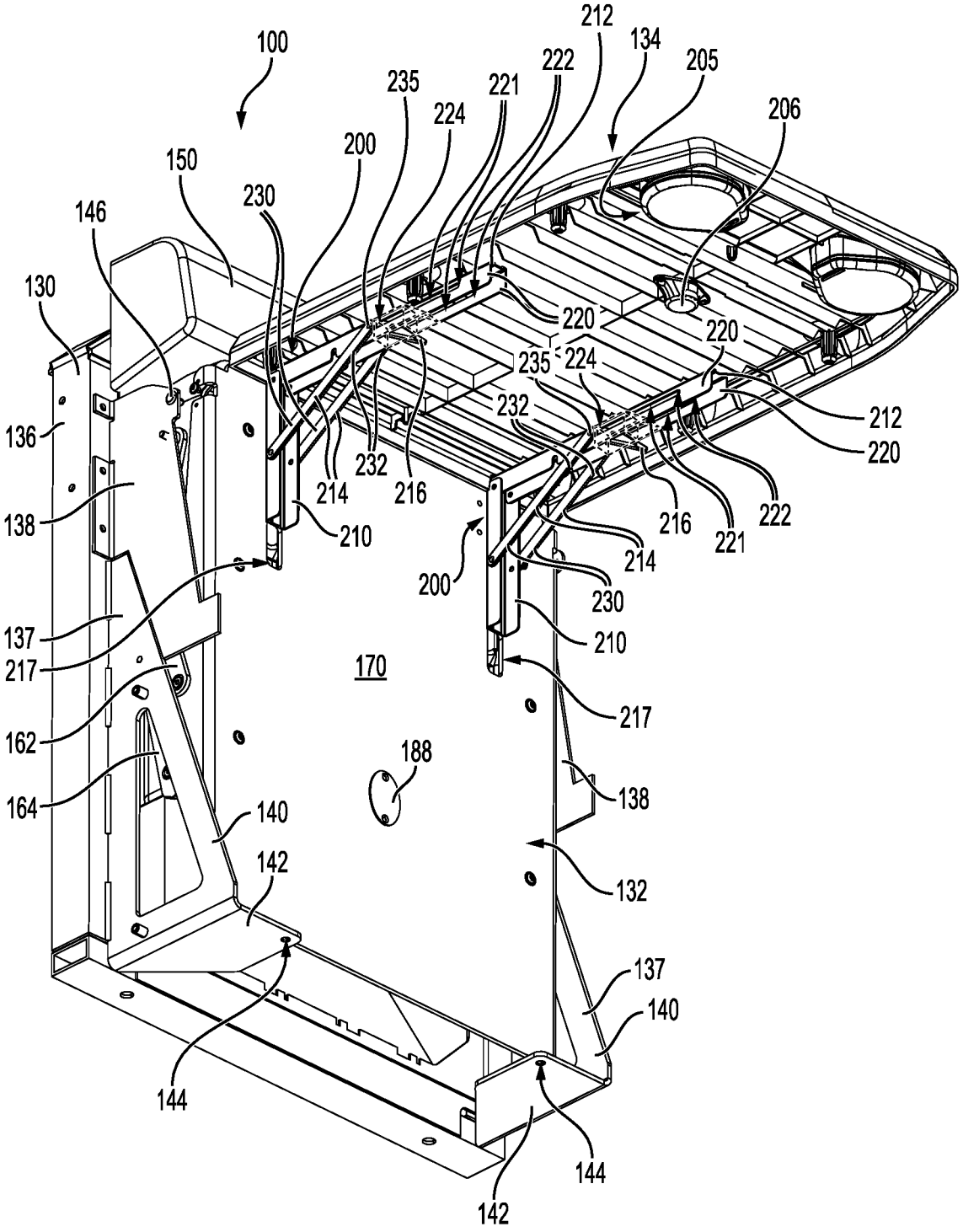
FIG. 12 is a perspective view taken from a bottom, front and left side of the furniture assembly of FIG. 11.

Referring to FIGS. 4 to 12, the furniture assembly 100 will now be described in greater detail. The furniture assembly 100 includes a base member 130, a seat member 132 and a table member 134. The furniture assembly 100 is selectively configurable between a storage configuration (FIGS. 4 and 5), a seat configuration (FIGS. 1 to 3 and 6 to 10) and a table configuration (FIGS. 11 and 12).

Henceforth, except where mentioned otherwise, terms related to spatial orientation when referring to the furniture assembly 100 and components thereof, such as "vertical", "horizontal", "forwardly", "rearwardly", "left", "right", "above" and "below", are as they would be understood by an individual sitting on the furniture assembly 100 with their back against the backrest 150 while the furniture assembly 100 is in the seat configuration. The furniture assembly 100 defines a center plane 101 (FIG. 3) that defines a left side of the furniture assembly 100 and a right side of the furniture assembly 100.

The base member 130 is connected to the deck 60 and the barrier structure 80. The base member 130 includes a frame 136, left and right lower brackets 137 and left and right upper brackets 138. It is contemplated that in some embodiments, the frame 136, the left and right lower brackets 137, and the left and right upper brackets 138 could be one integral member.

Figure 7:
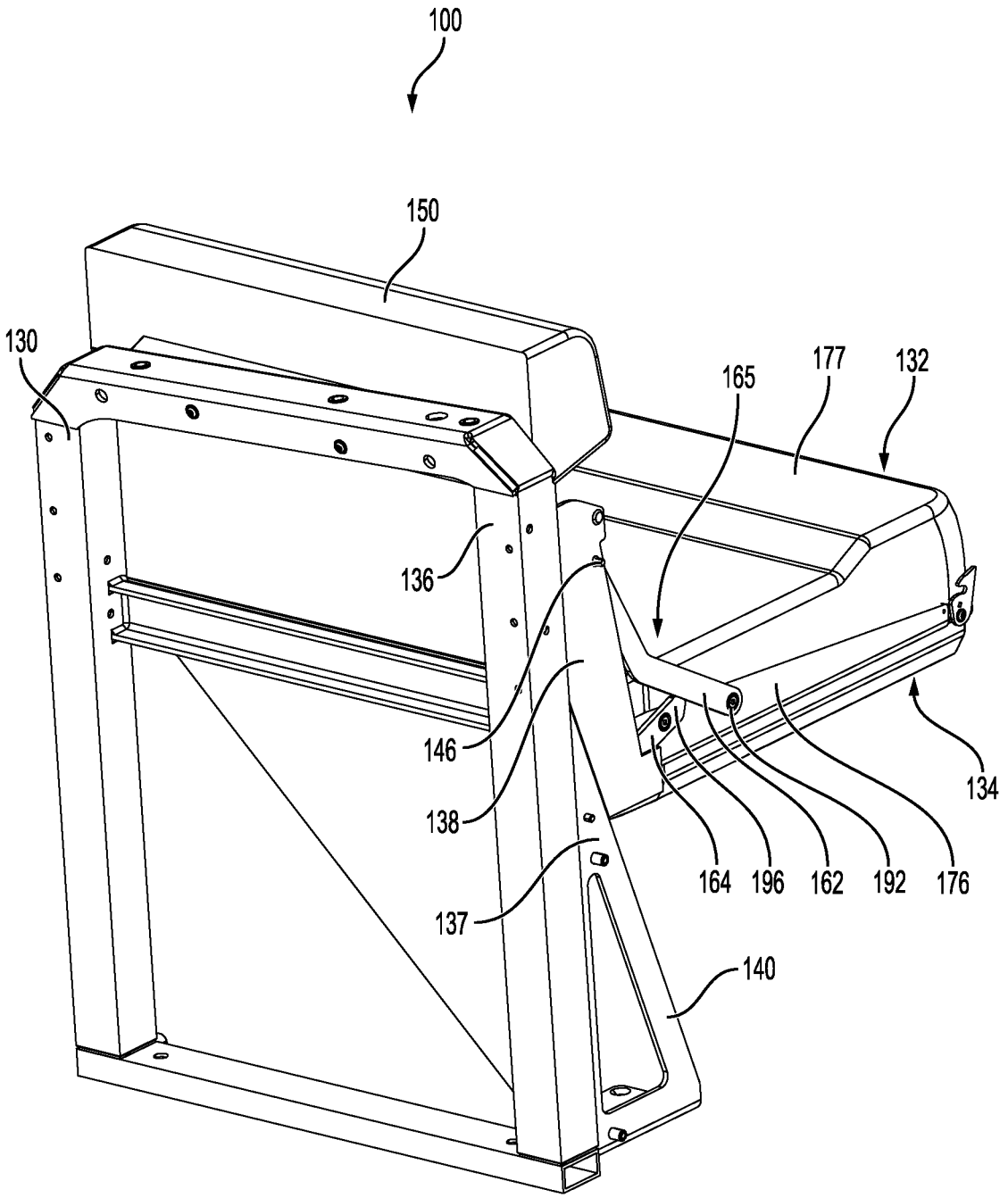
FIG. 7 is a perspective view taken from a top, front and right side of the furniture assembly of FIG. 6.
Figure 8:
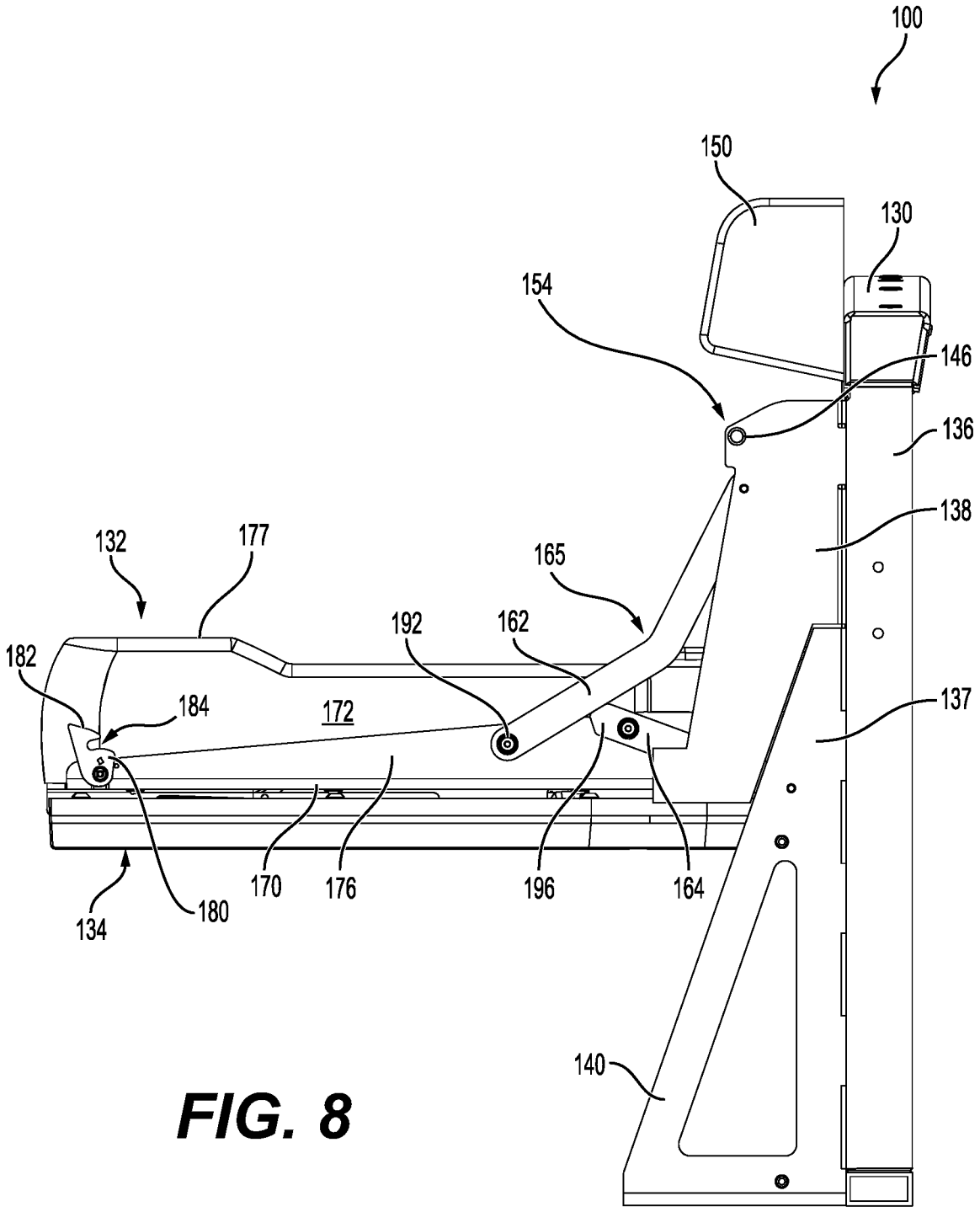
FIG. 8 is a rear elevation view the furniture assembly of FIG. 6.

The frame 136, which is configured to connect to the barrier structure 80, extends vertically from the upper surface 64 of the deck 60 toward a top of the barrier structure 80. The frame 136 also extends in the lateral direction (which corresponds to the longitudinal direction of the boat 50) between the seat 102 and the seat 104. As best seen in FIG. 7, a top of the frame 136 is slanted, so as to generally be aligned with the barrier structure 80, which also has a slanted upper surface at this location.

The left and right lower brackets 137 are connected to, respectively, the left and right sides of the frame 136. The left and right lower brackets 137 are welded to the frame 136. It is contemplated that in some embodiments, the left and right lower brackets 137 could be connected to the frame 136 differently, for example, via fasteners. The left and right lower brackets 137 each have a longitudinal segment 140 and a lateral segment 142. Each longitudinal segment 140 extends longitudinally and vertically, and has a triangular shape. Each lateral segment 142 extends from its corresponding longitudinal segment 140 toward the center plane 101, and defines an aperture 144 configured to receive a fastener (not shown) therein. Thus, the furniture assembly 100 can be fastened to the deck 60 via fasteners that are received through the apertures 144. The left and right lower brackets 137 assist in reinforcing the base member 130, so that the furniture assembly 100 can support a higher load.

The left and right upper brackets 138 are connected to, respectively, the left and right sides of the frame 136 via fasteners (not shown). It is contemplated that in some embodiments, the left and right upper brackets 138 could be connected to the frame 136 differently, for example, via welding. The left and right upper brackets 138 are disposed at least partially higher than the left and right lower brackets 137. The left and right upper brackets 138 each have a locking member 146. In the present embodiment, the locking members 146 are pins 146 that extend toward the center plane 101.

The base member 130 also includes a backrest 150 that is connected to the frame 136. The backrest 150, which is a cushioned backrest 150, extends laterally along an entire width of the frame 136. The backrest 150 is disposed on the frame 136, and is vertically sized such that a top surface of the backrest 150 is higher than an upper surface of the barrier structure 80. In other embodiments, the backrest 150 could be configured so that the top surface thereof is flush with, or lower than, the upper surface of the barrier structure 80. Additionally, as shown in FIGS. 1 and 2, the backrest 150 is sized, in the longitudinal direction, to be flush with the backrests 115, 125 of the seats 102, 104. It is contemplated that in other embodiments, the backrest 150 could be sized and/or disposed differently. The backrest 150 defines a central recess 152. As will be described below, the central recess 152 is for receiving part of a hand therein. In some embodiments, the central recess 152 could be omitted.

Below the backrest 150, the base member 130 defines a receiving recess 154. When the furniture assembly 100 is in the storage configuration, the receiving recess 154 is configured to receive the seat and table members 132, 134 therein. In other embodiments, when the furniture assembly 100 is in the storage configuration, the receiving recess 154 could be configured to receive the seat member 132, and only part of the table member 134. In other embodiments, when the furniture assembly 100 is in the storage configuration, the receiving recess 154 could be configured to only receive the seat member 132. In other embodiments, when the furniture assembly 100 is in the storage configuration, the receiving recess 154 could be configured to only receive part of the seat member 132.

Referring to FIGS. 5 to 9, the seat member 132 will now be described in greater detail. The seat member 132 is moveably connected to the base member 130, such that the seat member 132 is moveable relative to the base member 130 between a seat stowed position (FIGS. 4, 5, 11 and 12) and a seating position (FIGS. 1 to 3, and 6 to 10). In the seat stowed position, the seat member 132 is generally parallel to the base member 130, and is at least partially received in the receiving recess 154. In the seating position, the seat member 132 is generally parallel to the upper surface 64 of the deck 60 and/or generally perpendicular to the base member 130. It is contemplated that the orientation of the seat member 132 could vary from one embodiment to another.

The seat member 132 is moveably connected to the base member 130 by upper left and right seat connecting linkages 162 and lower left and right seat connecting linkages 164. The upper and lower left and right seat connecting linkages 162, 164, which form left and right four-bar linkage assemblies 165 with the base and seat members 130, 132, will be described in greater detail below.

The seat member 132 includes a platform 170 and a cushion 172 that is disposed on an upper side of the platform 170, with respect to the orientation of the platform 170 when the seat member 132 is in the seating position. The cushion 172 has a seating surface 177. Rearward from the cushion 172, the seat member 132 further has a receptacle 174 having three cupholders 175 that is also disposed on the upper side of the platform 170. It is contemplated that the number of cupholders 175 could vary from one embodiment to another. In some embodiments, the receptacle 174 defines one or more features other than a cupholder 175, such as a storage box for example. In some embodiments, the receptacle 174 could be omitted. The platform 170 has left and right connecting portions 176 disposed laterally outwardly from the cushion 172. As will be described below, the left and right connecting portions 176 are connected to upper left and right seat connecting linkages 162 and lower left and right seat connecting linkages 164.

Each one of the left and right connecting portions 176 has a locking member 180. The locking members 180 are the same, and thus only the locking member 180 connected to the left connecting portion 176 will be described in detail herein. The locking member 180 is pivotally connected to the left connecting portion 176 at a front end thereof. The locking member 180 is selectively moveable between an engaging position (shown by dotted lines in FIG. 5) and a non-engaging position (shown by solid line in FIG. 5). The locking member 180 is biased toward the engaging position. The locking member 180 is biased toward the engaging position by a resilient member such as a torsional spring 181 (schematically shown in FIG. 4). It is contemplated that the locking member 180 could be biased toward the engaging position differently. The locking member 180 has an arcuate portion 182 disposed at a rear end thereof, and defines a slot 184 that is sized to receive the corresponding pin 146 therein.

The locking member 180 and its corresponding pin 146 are configured such that when the seat member 132 is in the seat stowed position and the locking member 180 is in the engaging position, the pin 146 is received in the slot 184, thereby engaging the locking member 180 with the pin 146. When the locking member 180 and the pin 146 are engaged to one another, the seat member 132 is prevented from moving from the seat stowed position.

When the seat member 132 is in the seat stowed position and the locking member 180 is in the non-engaging position, the locking member 180 does not engage the pin 146. More specifically, the locking member 180 has moved such that the pin 146 is no longer received in the slot 184.

It will be noted that when the seat member 132 is moved toward the seat stowed position, and the locking member 180 is in the engaging position (due to its bias), as the locking member 180 is pushed against the pin 146, and due to the arcuate portion 182, the locking member 180 moves toward the non-engaging position until the slot 184 aligns with the pin 146, at which point the locking member 180 moves to the engaging position (due to its bias) and engages the pin 146. As such, a user of the seat assembly 100 does not have to manually actuate the locking member 180 to lock the seat member 132 in the seat stowed position. The user simply has to move the seat member 132 to the seat stowed position and the locking member 180 will engage the pin 146 in response to this movement.

The seat member 132 also has a handle 186 that is operatively connected to the locking member 180. The handle 186 is actuable to selectively cause the locking member 180 to move between the engaging and non-engaging positions. In some embodiments, the handle 186 could be biased toward a resting position by a resilient member such as a spring (not shown). When the handle is in the resting position, the locking member 180 is in the engaging position. Thus, the locking member 180 could be biased toward the engaging position by the handle 186. The handle 186 is, at least in part, disposed between the platform 170 and the cushion 172. The handle 186 is accessible via a cushion recess 173. Access to the handle 186 is facilitated by the central recess 152 of the backrest 150.

Figure 9:
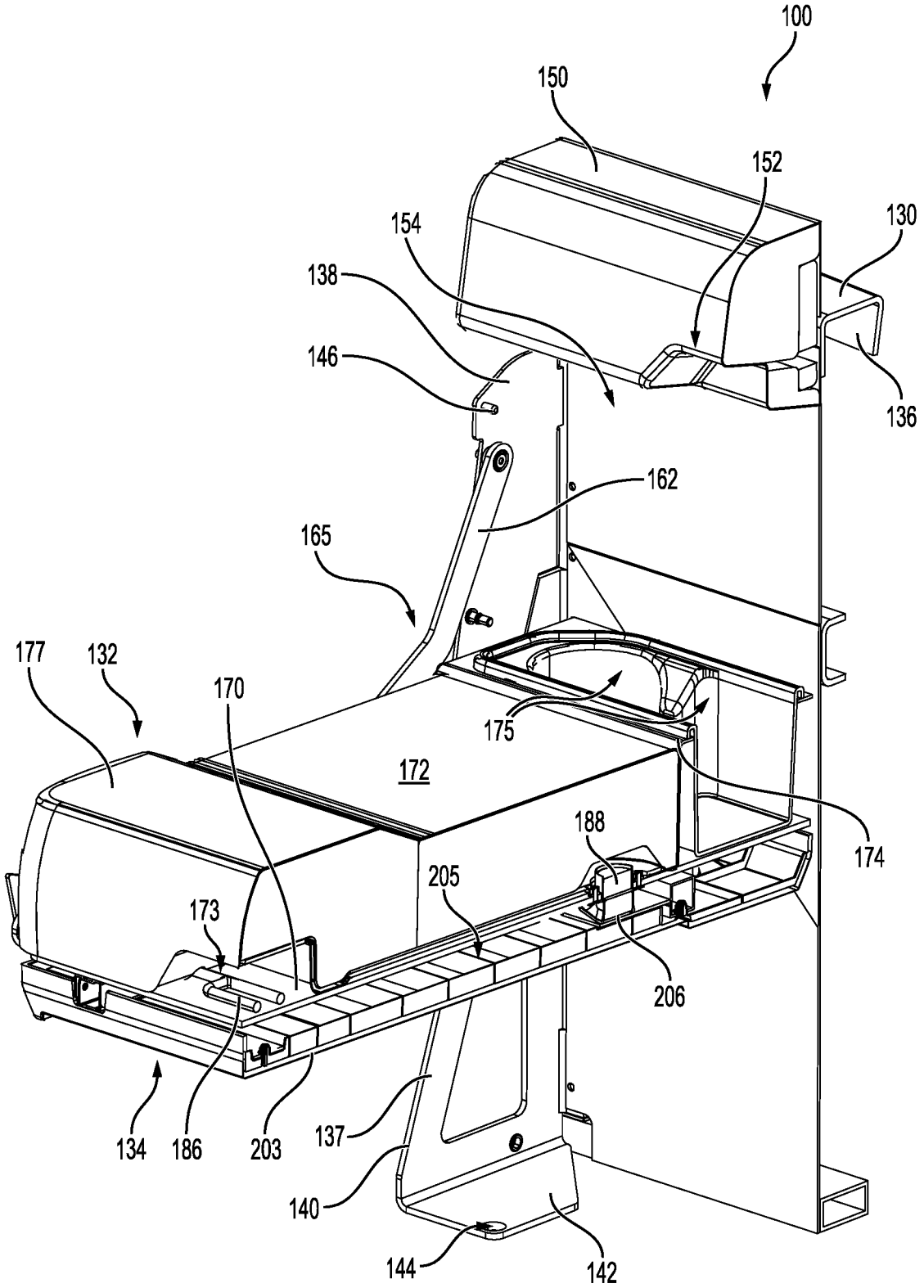
FIG. 9 is a perspective view taken from a top, rear, left side of a cross-section of the furniture assembly of FIG. 6, the cross-section being taken along line 9-9 of FIG. 3.
Figure 10:
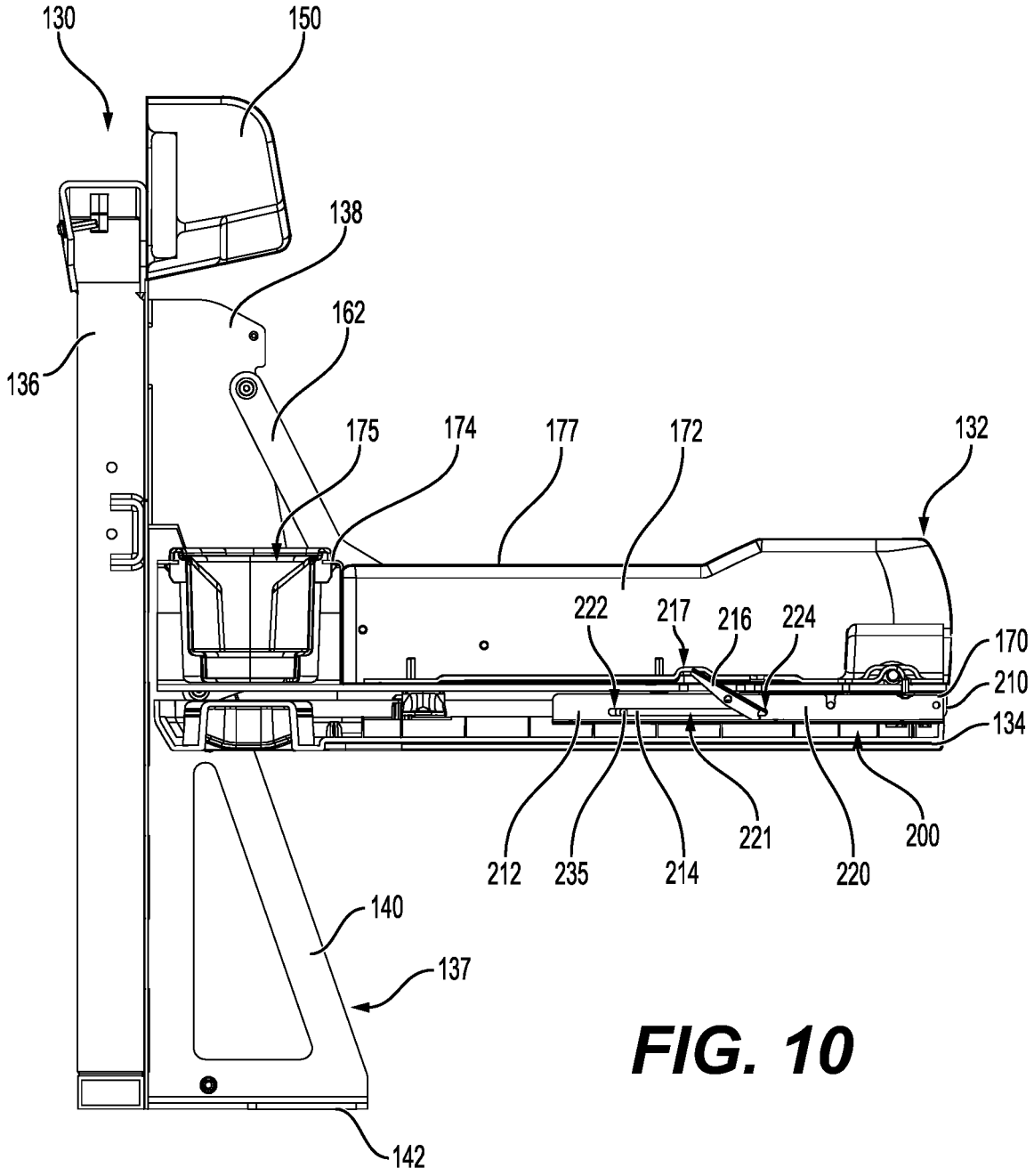
FIG. 10 is a cross-section view of the furniture assembly of FIG. 6, the cross-section being taken along line 10-10 of FIG. 3.

The seat member 130 further has a retainer 188 disposed at a bottom side thereof, as shown in FIG. 9. The retainer 188 is a magnet. It is contemplated that the retainer 188 could be another type of retainer such as a strip of hook fasteners or a strip of loop fasteners.

With reference to FIGS. 5 to 8, the four-bar linkage assemblies 165 will now be described in greater detail.

Being that the left and right four-bar linkage assemblies 165 are similar, only the left four-bar linkage assembly 165 will be described.

The upper left seat connecting linkage 162 is pivotally connected to the base member 130 and is pivotally connected to the seat member 132. More precisely, the upper left seat connecting linkage 162 has an end 190 pivotally connected to an upper end of the upper left bracket 138, and an end 192 pivotally connected to the left connecting portion 176. The upper left seat connecting linkage 162 has a V-shape. More specifically, the upper left seat connecting linkage 162 has a boomerang shape.

The lower left seat connecting linkage 164 is pivotally connected to the base member 130 and is pivotally connected to the seat member 132. More precisely, the lower left seat connecting linkage 164 has an end 194 pivotally connected to an upper end of the lower left bracket 137, and an end 196 pivotally connected to the left connecting portion 176. It is contemplated that in other embodiments, the end 194 of the lower left seat connecting linkage 164 could be connected to a lower end of the upper left bracket 138.

When the seat member 132 is in the seat stowed position, the end 194 is closer to the barrier structure 80 (i.e., closer to the frame 136), than the ends 190, 192, 196. To move toward the seating position, with reference to FIG. 5, the upper left seat connecting linkage 162 pivots in a clockwise direction relative to the upper left bracket 138, and the lower left seat connecting linkage 164 pivots in a clockwise direction relative to the lower left bracket 137. Movement of the seat member 132 is stopped upon reaching the seating position. In some embodiments, the movement is stopped at the seating position due to the end 196 of the lower left seat linkages 164 abutting part of the upper left seat connecting linkage 162. In other embodiments, movement of the seat member 132 can be stopped due to a rear end of the seat member 132 abutting the frame 136.

When the seat member 132 is in the seating position, the end 196 is disposed vertically higher than the ends 192, 194. Additionally, the end 196 is closer to the barrier structure 80 (i.e., closer to the frame 136) than the end 192. To move toward the seat stowed position, with reference to FIG. 8, the upper left seat connecting linkage 162 pivots in a counter-clockwise direction relative to the upper left bracket 138, and the lower left seat connecting linkage 164 pivots in a counter-clockwise direction relative to the lower left bracket 137.

The four-bar linkage configuration enables the seat member 132 to be generally parallel to the base member 130 in the seat stowed position, and to be generally perpendicular to the base member 130 in the seating position. Additionally, movement of the seat member 132 between the seat stowed position and the seating position is not impeded by a shape of the base member 130, as it may be by a pivotal connection. It is contemplated that the seat member 132 could be connected to the base member 130 differently.

Referring to FIGS. 9 to 12, the table member 134 will now be described in greater detail. The table member 134 is moveably connected to a bottom side of the seat member 132. The table member 134 is moveable relative to the seat member 132 between a table stowed position (FIGS. 1 to 10) and an extended position (FIGS. 11 and 12). In the table stowed position, the table member 134 is generally parallel to the seat member 132. In the table stowed position, the table member 134 rests against the platform 170 of the seat member 132. In the extended position, the table member 134 is generally parallel to the upper surface 64 of the deck 60.

The table member 134 is pivotally connected to the seat member 132 by left and right table connecting assemblies 200, which will be described in greater detail below.

As best seen in FIG. 11, with respect to the table member 134 being in the extended position, at an upper side 203 thereof, the table member 134 has a recessed flat section 202, and two cupholders 204. In some embodiments, the recessed flat section 202 could not be recessed (e.g., the recessed flat section 202 could be a raised flat section 202). In other embodiments, the recessed flat section 202 could be a ribbed surface 202. In some embodiments, there could be a single cupholder 204 or three or more cupholders 204. It is contemplated that in other embodiments, the recessed flat section 202 and the two cupholders 104 could be omitted, and the table member 134 could have a generally flat upper side 203. As best seen in FIG. 12, at an underside 205 thereof, the table member 134 has a retainer 206. The retainer 206 is a magnet 206. As will be described below, the retainer 206 is configured to engage with the retainer 188 to keep the table member 134 retained to the seat member 132 (i.e., keep the table member 134 in the table stowed position).

Figure 13:
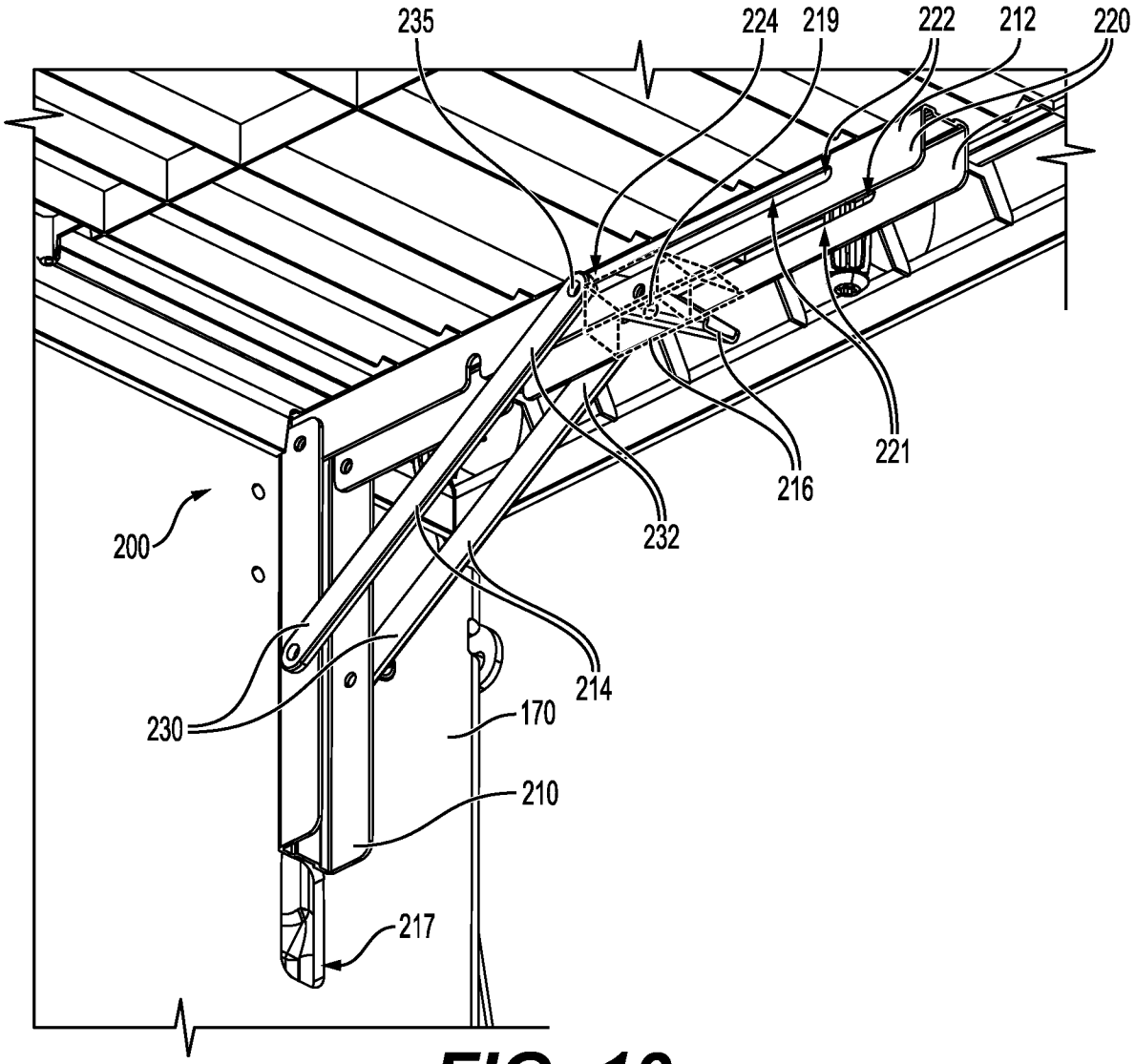
FIG. 13 is a perspective view taken from a bottom, front, left side of a left connecting assembly of the furniture assembly of FIG. 12.

Referring to FIGS. 12 and 13, the left and right table connecting assemblies 200 will now be described in greater detail. In other embodiments, there could be one or three or more connecting assemblies 200. The left and right connecting assemblies 200 are the same. As such, only the left table connecting assembly 200, henceforth referred to as table connecting assembly 200, will be described in detail herewith.

The table connecting assembly 200 includes a table bracket 210, a table connecting linkage 212, table connecting linkages 214 and a table lock 216.

The table bracket 210 is connected to the seat member 132. More specifically, the table bracket 210 is connected to a bottom of the platform 170. The table bracket 210 is disposed at a front end of the platform 170, and extends in the longitudinal direction. Rearwardly from the table bracket 210, the platform 170 defines a recess 217 that, as will be described below, is configured to receive part of the table lock 216 therein.

The table connecting linkage 212 is a table bracket 212. The table bracket 212 is connected to the underside 205 of the table member 134, and is laterally aligned with the table bracket 210. In the illustrated embodiment, the table bracket 212 is configured to be received in the table bracket 210. The table bracket 212 has two lateral portions 220 that extend away from the underside 205 of the table member 134. It is contemplated that the configuration of the table bracket 212 could vary from one embodiment to another. In one example, the table bracket 212 could have a single portion 220. Each of the lateral portion 220 defines a slot 221 that extends generally parallel to the table member 132. Each slot 221 has a slot end 222 and a slot end 224.

The table lock 216 is pivotally to the table bracket 212. More specifically, the table lock 216 is disposed between the lateral portions 220 proximate to the slot end 224. The table lock 216 is moveable between a locked position (shown by solid line in FIGS. 12 and 13) and an unlocked position (shown by dotted lines in FIGS. 12 and 13). The table lock 216 is biased toward the locked position. The table lock 216 is biased toward the locked position by a resilient member such as a spring 219 (schematically shown in FIG. 13). It is contemplated that the table lock 216 could be biased toward the locked position differently.

In the present embodiment, there are two table connecting linkages 214. It is contemplated that in other embodiments, there could be a single connecting linkage 214. Each table connecting linkage 214 is pivotally connected to the seat member 132 via the table bracket 210, and is connected to the table bracket 212. In more detail, the table connecting linkages 214 each have a linkage end 230 pivotally connected to the table bracket 210. and a linkage end 232. The linkage ends 232 of the table connecting linkages 214 are interconnected by a pin 235. The pin 235 is received in the slots 221 such that the linkage ends 232 and the pin 235 are moveable along the slots 221, and movement thereof can be restricted by the table locks 216.

In the table stowed position, the pin 235 is at a stowed slot position in the slots 221. The pin 235 is at the slot ends 222. The table lock 216 is in the locked position, and is partially received in the recess 217 (shown in FIG. 10). Part of the under side 203 of the table member 134 rests against a bottom of the platform 170. The retainers 188, 206 are engaged with one another via magnetic forces, thereby retaining the seat and table members 132, 134 connected to one another.

To move the table member 134 toward the extended position, the table member 134 is pulled away from the seat member 132. The retainers 206, 188 are configured to be disengaged upon application of a predetermined force. As the table member 134 is pulled away from the seat member 132, the table connecting linkages 214 pivot relative to the table bracket 210, and the pin 235 moves in the slots 221 toward the slot ends 224. The table lock 216 is configured such that in response to abutment with the pin 235, as the pin 235 is moving towards the slot ends 224, the table lock 216 moves toward the unlocked position. Once the pin 235 passes the table lock 216, the table lock 216 returns to its locked position.

When the pin 235 reaches the slot ends 224, the pin 235 is in the extended slot positions. The table lock 216 is in the locked position, and prevents movement of the pin 235 towards the stowed slot position (i.e., towards slot ends 222).

To move the table member 134 back toward the table stowed position, the table locks 216 have to be moved to their unlocking positions. This can be done manually.

The furniture assembly 100 being configured between the storage, seat and table configurations will now be described in greater detail.

As shown in FIGS. 1 to 5, the furniture assembly 100 is in the storage configuration. In the storage configuration, the seat member 132 is in the seat stowed position, and the table member 134 is in the table stowed position. The seat and table members 132, 134 are received in the receiving recess 154. The seating surface 177 abuts the frame 136, and the underside 205 of the table member 134 abuts the platform 170. The retainer 188 of the seat member 132 is engaged to the retainer 206 of the table member 134, to retain the seat member 132 and the table member 134 connected to one another (i.e., keep the table member 134 in the table stowed position). The locking members 180 are in their engaging positions, such that the pins 146 are received in their corresponding slots 184. Thus, as mentioned above, movement of the table member 132 from the seat stowed position is prevented. In the storage configuration, the furniture assembly 100 takes a minimal amount of space on the deck 60. Indeed, in the present embodiment, when the furniture assembly 100 is in the storage configuration, the table member 134 is generally flush with the backrests 115, 125 of the rear furniture unit 54. Thus, in the storage configuration, the furniture assembly 100 can provides storage space on the boat 50 and/or can enable people sitting on the seats 102, 104 to put their legs in the space that would otherwise be occupied by the seat member 132.

To configure the furniture assembly 100 to the seat configuration, the seat member 134 is moved to the seating position, and the table member 134 is kept in the table stowed position. This can be done by moving the locking members 180 to their non-engaging positions by actuating the handle 186, and moving the seat member 134 to the seating position.

As shown in FIGS. 6 to 10, the furniture assembly 100 is in the seat configuration. In the seat configuration, the seat member 132 is in the seating position, and the table member 134 is still in the table stowed position. Thus, the underside 205 of the table member 134 still abuts the platform 170. The engagement between the retainers 188, 206 is strong enough so that when the seat member 132 is in the seating position, the table member 134 remains in the table stowed position (i.e., overcomes gravitational forces applied on the table member 134). In the seat configuration, the furniture assembly 100 provides a seat on the boat 50. It is to be noted that the provided seat is generally vertically aligned with the seat members 112, 122 of the seats 102, 104, such that at least part of the seating surface 177 of the cushion 170 is vertically aligned with seating surfaces of the seats 102, 104. This can improve comfort. Additionally, by moving the seat member 132 to the seating position, the cupholders 175 are made accessible. The cupholders 175 are disposed behind the cushion 170, and thus do not impede sitting on the seat member 132.

To configure the furniture assembly 100 to the table configuration, the seat member 134 is moved to the seat stowed position, and the table member 134 is moved to the table stowed position. From the seat configuration, this can be done by moving the seat member 134 toward the seat stowed position. The locking members 180 will, as described above, engage the pins 146, and keep the seat member 134 in the seat stowed position. Additionally, the table member 134 can be moved toward the extended position as described hereabove.

As shown in FIGS. 11 and 12, the furniture assembly 100 is in the table configuration. In the table configuration, the seat member 132 is in the seat stowed position, and the table member 134 is in the extended position. The table member 134 remains in the extended position due to the table locks 216.

In the table configuration, the furniture assembly 100 provides a table on the boat 50. It is to be noted that the provided table is vertically higher than the seat members 112, 122 of the seats 102, 104. Thus, someone sitting on one of the seats 102, 104 can comfortably make use of the table member 134.

Modifications and improvements to the above-described embodiments of the present technology may become apparent to those skilled in the art. The foregoing description is intended to be exemplary rather than limiting. The scope of the present technology is therefore intended to be limited solely by the appended claims.

What is claimed is:

1. A furniture assembly for a watercraft, the furniture assembly comprising:

a base member configured to connect to a surface of the watercraft;

a seat member moveably connected to the base member, the seat member being moveable relative to the base member between a seating position and a seat stowed position;

a table member moveably connected to the seat member, the table member being moveable relative to the seat member between an extended position and a table stowed position;

a first seat connecting linkage having a first end pivotally connected to the base member and a second end pivotally connected to the seat member; and a second seat connecting linkage having a third end pivotally connected to the base member and a fourth end pivotally connected to the seat member, the first and second seat connecting linkages moveably connecting the seat member to the base member, and the first seat connecting linkage, the second seat connecting linkage, the seat member and the base member defining a four-bar linkage assembly, and the furniture assembly being selectively configured between:

a storage configuration, in which the seat member is in the seat stowed position and the table member is in the table stowed position;

a seat configuration, in which the seat member is in the seating position; and a table configuration, in which the seat member is in the seat stowed position and the table member is in the extended position.

2. The furniture assembly of claim 1, wherein in the seat configuration, the table member is in the table stowed position.

3. The furniture assembly of claim 1, wherein:

in the seat stowed position, the third end is configured to be closer to the surface of the watercraft than the first, second and fourth ends; and in the seating position, the fourth end is disposed vertically above the second and third ends.

4. The furniture assembly of claim 1, wherein the table member is pivotally connected to the seat member.

5. The furniture assembly of claim 1, further comprising:

a first seat locking member connected to one of the seat member and the base member;

a second seat locking member connected to an other one of the seat member and the base member; and the first seat locking member being moveable between a first position and a second position, and with the seat member in the seat stowed position and the first seat locking member in the first position, the first and second locking members are engaged with one another, and prevent the seat member from moving from the seat stowed position, and with the seat member in the seat stowed position and the first seat locking member in the second position, the first and second locking members are disengaged from one another, and the seat member is moveable toward the seating position.

6. The furniture assembly of claim 5, wherein the first seat locking member is biased towards the first position.

7. The furniture assembly of claim 1, further comprising a first retainer connected to the seat member, a second retainer connected to the table member, the first and second retainers being selectively connected to one another for retaining the table member in the table stowed position.

8. The furniture assembly of claim 1, wherein the base member defines a recess, and with the seat member being in the seat stowed position, the recess at least partially receives the seat member.

9. The furniture assembly of claim 8, wherein with the furniture assembly being in the storage configuration, the recess at least partially receives the table member.

10. The furniture assembly of claim 1, wherein the base member has a backrest.

11. The furniture assembly of claim 1, wherein in the table stowed position, the table member rests against a bottom of the seat member.

12. The furniture assembly of claim 1, wherein in the table extended position, a top of the table is configured to be generally parallel to an upper surface of the watercraft.

13. A furniture unit comprising:

the furniture assembly of claim 1, the furniture assembly being configured to connect to the surface of the watercraft, and the seat member is a first seat member; and a second seat member configured to connect to the surface of the watercraft, the second seat member being disposed adjacent to the furniture assembly, and wherein:

with the furniture assembly being in the seat configuration, the second seat member is generally vertically aligned with the first seat member; and with the furniture assembly being in the table configuration, the table member is disposed vertically higher than the second seat member.

14. A furniture assembly for a watercraft, the furniture assembly comprising:

a base member configured to connect to a surface of the watercraft;

a seat member moveably connected to the base member, the seat member being moveable relative to the base member between a seating position and a seat stowed position;

a table member pivotally connected to the seat member, the table member being moveable relative to the seat member between an extended position and a table stowed position;

a first table connecting linkage connected to one of the table member and the seat member, the first table connecting linkage defining a slot extending generally parallel to the one of the table member and the seat member; and a second table connecting linkage pivotally connected to an other one of the table member and the seat member, part of the second table connecting linkage being received in the slot, the part of the second table connecting linkage being slidable along the slot between:

a first slot position, in which the table member is in the table stowed position, and a second slot position, in which the table member is in the extended position;

the first and second table connecting linkages moveably connecting the table member to the seat member, the furniture assembly being selectively configured between:

a storage configuration, in which the seat member is in the seat stowed position and the table member is in the table stowed position;

a seat configuration, in which the seat member is in the seating position; and a table configuration, in which the seat member is in the seat stowed position and the table member is in the extended position.

15. The furniture assembly of claim 14, further comprising a table lock pivotally connected to the first table connecting linkage, the table lock being moveable between:

a locked position, in which the table lock prevents the part of the second table connecting linkage to move from the second slot position toward the first slot position; and an unlocked position, in which the table lock permits movement of the second table connecting linkage to move from the second slot position toward the first slot position.

16. The furniture assembly of claim 15, wherein in response to the part of the second table connecting linkage moving toward the second slot position, the part of the second table connecting linkage causes the table lock to move to the unlocked position.

17. The furniture assembly of claim 15, wherein the table lock is biased towards the locked position.

18. The furniture assembly of claim 14, further comprising:

a first seat locking member connected to one of the seat member and the base member;

a second seat locking member connected to an other one of the seat member and the base member; and the first seat locking member being moveable between a first position and a second position, and with the seat member in the seat stowed position and the first seat locking member in the first position, the first and second locking members are engaged with one another, and prevent the seat member from moving from the seat stowed position, and with the seat member in the seat stowed position and the first seat locking member in the second position, the first and second locking members are disengaged from one another, and the seat member is moveable toward the seating position.

19. The furniture assembly of claim 14, further comprising a first retainer connected to the seat member, a second retainer connected to the table member, the first and second retainers being selectively connected to one another for retaining the table member in the table stowed position.

20. A watercraft comprising:

a deck;

a hull supporting the deck;

a motor connected to the hull; and a furniture assembly comprising:

a base member connected to a surface of the deck;

a first seat member moveably connected to the base member, the first seat member being moveable relative to the base member between a seating position and a seat stowed position; and a table member moveably connected to the first seat member, the table member being moveable relative to the first seat member between an extended position and a table stowed position, and the furniture assembly being selectively configured between:

a storage configuration, in which the first seat member is in the seat stowed position and the table member is in the table stowed position;

a seat configuration, in which the first seat member is in the seating position; and a table configuration, in which the first seat member is in the seat stowed position and the table member is in the extended position, and a second seat member connected to the surface of the deck, the second seat member being disposed adjacent to the furniture assembly, and with the furniture assembly being in the seat configuration, the second seat member is generally vertically aligned with the first seat member; and with the furniture assembly being in the table configuration, the table member is disposed vertically higher than the second seat member.

* * * * *